United States Patent [19]

Beetz et al.

[11] 4,145,807

[45] Mar. 27, 1979

[54] PROCEDURE AND INSTALLATION FOR THE MANUFACTURE OF PARTIAL LACED WIRING HARNESSES

[75] Inventors: Horst Beetz; Alfred Könnemann; Manfred Brandstäter; Rudolf Reinertz, all of Wuppertal, Fed. Rep. of Germany

[73] Assignee: Grote & Hartmann GmbH & Co. KG, Wuppertal, Fed. Rep. of Germany

[21] Appl. No.: 870,758

[22] Filed: Jan. 19, 1978

[30] Foreign Application Priority Data

Jan. 20, 1977 [DE] Fed. Rep. of Germany ..... 2702188

[51] Int. Cl.[2] ..... H01R 43/00

[52] U.S. Cl. ..... 29/628; 29/564.4; 29/564.8

[58] Field of Search ..... 29/628, 564.4, 564.8, 29/630 A; 140/1

[56] References Cited

U.S. PATENT DOCUMENTS

| | | | |
|---|---|---|---|
| 3,029,494 | 4/1962 | Andren | 29/628 |
| 3,032,860 | 5/1962 | Andren | 29/628 |
| 3,353,571 | 11/1967 | Durr | 140/1 |
| 3,636,610 | 1/1972 | Williams | 29/564.8 |
| 3,766,624 | 10/1973 | Grebe | 29/564.8 |
| 4,030,174 | 6/1977 | Buttner | 29/564.4 |
| 4,077,118 | 3/1978 | McKeever | 29/628 |

*Primary Examiner*—C.W. Lanham
*Assistant Examiner*—Gene P. Crosby
*Attorney, Agent, or Firm*—Friedman, Goodman & Teitelbaum

[57] ABSTRACT

A procedure and installation for the manufacture of partial laced wiring harnesses in which each cable is pulled from an independent feeder and fed into a horizontal plane, then gripped at a forward free end. Each cable is then independently transported further in a constant stretch in an axial direction of the wiring harness to obtain a preselected length for each cable, where the cable is preferably arranged in the form of a loop and disposed in a transport installation. The front and rear portion of the preselected length of cable are gripped by members of the transport installation, and the forward free end is released. After cutting the cable to length, the cable is still gripped at the front and the rear portion thereof and is transported further horizontally at right angles to the axial direction of the cable ends. Then, at least one end area of the cable is bared and provided with a connector and thereafter provided with a casing.

17 Claims, 7 Drawing Figures

PROCEDURE AND INSTALLATION FOR THE MANUFACTURE OF PARTIAL LACED WIRING HARNESSES

BACKGROUND OF THE INVENTION

The present invention relates to a procedure and installation for the manufacture of partial laced wiring harnesses.

U.S. Pat. No. 3,766,624 discloses a prior art installation by which the laced wiring harnesses are manufactured. This installation has several feeders for different cable types from which is drawn a specific cable by a roller feeder and which is cut to length by the formation of loops in a cutting-to-length installation. After cutting the cable to length, the cable is disposed at right angles to the feeder transporation installation which carries the cable to a position in front of a baring, fixing and casing installation which is specific for each type of cable, where only then are the other cables which belong to the laced wiring harness added. The disadvantage in this installation is that only one cable can be handled each time. The cutting-to-length process is intermittent and results in a substantial amount of time required for each unit. The machine elements of the cutting-to-length unit are constructed in a very complicated manner and can execute only relatively slow movements. Furthermore, the subsequent units which follow in the process line do not function in accordance with a working cycle, which also requires a substantial amount of time in function thereof. Additionally, the control expenditure for this known installation is very important in the functioning thereof.

An installation for simultaneously leading several cables parallel to each other for cutting the cables to length and the baring thereof is disclosed in U.S. Pat. No. 3,353,571. In this installation, all the free ends of the cables are gripped simultaneously and pulled at a constant length. Thereafter, the cables are pulled further to provide a formation of loops in the free chain space. In particular, these two pulling processes with two work cycles are disadvantageous in that the cables are stretched in an uncontrollable manner. After this step, the cables are seized at their rear end portions and further transported together without any direction modification. The rear end portions shortly before being cut are left free, while the front ends are passed over to a transport element. This known installation requires a very long change-over time for the modification of the cutting-to-length program, and also requires numerous cutting-to-length elements. The longest possible length of a cable in this installation is determined by the diameter of the chain wheels of the transportation chain, where the cable loop slack, to preclude hang-ups, cannot come into contact with the lower chain drum. Further, after being cut, the rear cable ends are not controlled.

SUMMARY OF THE INVENTION

The purpose of the present invention, while avoiding the disadvantages of known installations, is to provide a procedure as well as an installation which, in particular, can operate very fast, and can manufacture the partial laced wiring harnesses with different cable lengths and which, in particular, makes it possible to manufacture double mountings and to also sort the cable ends before the casing armement is provided thereon.

Accordingly, it is an object of the present invention to provide an improved procedure and installation for the manufacture of partial laced wiring harnesses which solves the aforementioned problems of the prior art devices.

According to the present invention, all the cables of a partial laced wiring harness are fed simultaneously parallel to each other into a plane, are cut to length and are then carried away together while being gripped on at least one end portion, preferably on both opposite end portions. In accordance with a special embodiment of the present invention, the cables before being cut to a desired length or lengths, are all gripped simultaneously on all free ends thereof. The cables are first continuously fed forward in a constant stretch respectively to a predetermined length, or preferably to different lengths, while being gripped at the front end thereof. Then, the front end portion and preferably also the rear end portion are gripped by the transportation installation, after which the forward free end is released and the cables are simultaneously cut.

The installation of the present invention not only permits the production of partial laced wiring harnesses with identical or different cable lengths with a single or double side stop and one-sided or double sided armement in a single or multiple series casings with identical or different chambers of different or identical cross-sections and conductor colors, but also permits the formation of double bindings, specifically double stops, in which either the front free ends of two or more cables or the rear end area of two or more cables are brought together before the gripping thereof. On top of this, it is particularly advantageous that in the present invention, the conductor number of a partial laced wiring harness can be preselected, where before the gripping thereof, the front free ends of one or more cables can be pulled back. Thereafter, either the specific pulled back cable is not fed by the roller feeder to the cutting-to-length installation, so that the number of cables is reduced, or the roller feeder can move the specific pulled back cable forwards so that a single end of a conductor of the laced wiring harness is without baring and stop.

The present invention further provides that the cables ends are bared simultaneously, are provided with connectors and several, preferably all, are simultaneously inserted in the casing chambers of a casing. Preferably too, the front and/or rear free ends of the cables, especially after the bearing, are cut in identical alignment or in different lengths. This precision cutting is mandatorily made after the bearing, in order that the copper shreds which fall off during the cutting can be collected.

A particular advantage of the present invention is the sorting process after the step of providing the stops of the connectors, which in an advantageous manner occurs over a matrix card. Accordingly, cable transport grippers are used to obtain desired different heights, where after reaching the end position, the cables are lifted, and if necessary are turned, so that the cable longitudinal axis preferably rotates 90°. This rotation is required when the formation of the connectors, especially their position in the casing, prescribes it. The sorted cable ends are carted horizontally. Thus, in a particularly simple manner, one can simultaneously proceed with the transfer from the cable cart into the casing chamber screen. This inventive sorting can result in a desired manner for the ranging of the lines diagonally to the parallel drawn strand. By this, double stops can also be ranged. A line change of the path in the cutting-to-length zone is then only required when the number of the specific cross-sections inside the strand is changed or when another conductor color is required. In this manner, nearly unlimited cable formations are obtained.

Furthermore, another object of the invention also concerns an installation for the execution of the procedure. Essentially, this installation includes a cutter, transporation, baring, arresting and armement installation, in which the cutter installation includes a roller feed and a gripper, as well as a guiding element for each cable, and the transportation installation includes grippers for the front and the rear end of the cable. This new installation distinguishes itself in that the cutting-to-length installation includes a roller feed for each cable.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings like reference characters designate like parts.

DETAILED DESCRIPTION OF THE PREFERRED EMBODIMENT

Figure 1:
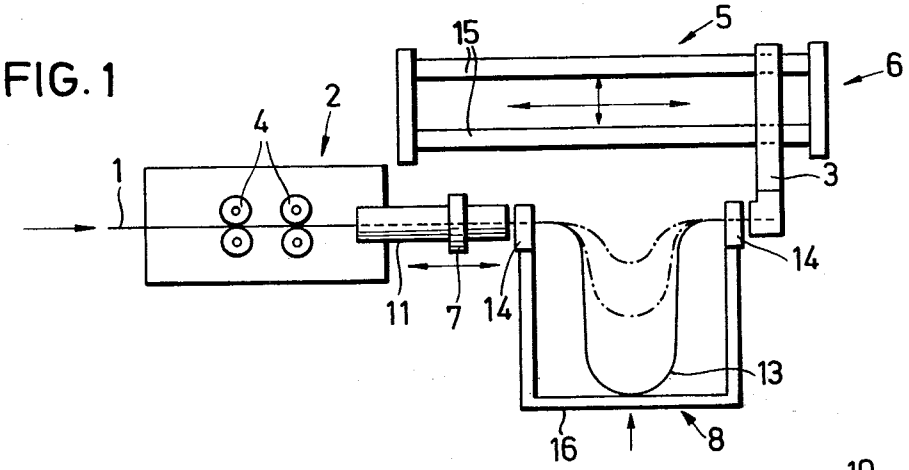
FIG. 1 is a schematic representation of a cutting-to-length installation according to the present invention.

Preferably, as shown in the drawings, the installation of the present invention processes eight cables 1 at a time, where this number may be increased or decreased if desired. Each cable 1 has a cross-sectional range of 0.3 $mm^2$ to 6 $mm^2$, while the length of a double stop is selected over 150 mm to about 4000 mm, and a single side stop is over 80 mm to about 4000 mm.

Essentially, the installation in accordance with the present invention includes a cutting-to-length installation 5, a transportation installation 8, a baring-and-cutting installation 9, an arresting installation 10 and an armement installation 12. The cutting-to-length installation 5 includes a roller feed 2 and a grip installation 6 having gripper rods 3, as well as cutters 7 associated with cable guides 11, as shown in FIG. 1.

For cutting the cables to length, which are received from a conventional holder (not shown), all the cables 1 are transported simultaneously and continuously by means of the roller feed 2, after the gripper rods 3 have first seized the free cable ends. The gripper rods 3 and the cutter 7 with the cable guide 11 move, to the right as shown in FIG. 1, synchronically with the movement of the rollers 4 of the roller feed 2, while the gripper rods 3 only engage the front free end of the cables.

After the passage of a given constant stretch, the gripper rods 3, the cutter 7 and the roller feed 2 are stopped, and then the roller feed feeds the cable 1 further to a predetermined length whereby the cable undergoes the formation of a loop 13, as shown in FIG. 1. After the loop 13 is formed by this process, the rods 14 of the transportation installation 8 simultaneously grip the front and the rear end portions of the cable, and the gripper rods 3 opens and releases the front free cable end. Following the action of the rods 14 and gripper rods 3, the cutter 7 cuts the cables. The gripper rods 3 are then lifted up and are glided back, to the left as shown in FIG. 1, on the guiding elements 15 and are finally lowered to the starting position thereof. Simultaneously, the cutter 7 also glides back to the starting position together with the cable guides 11.

Figure 3:
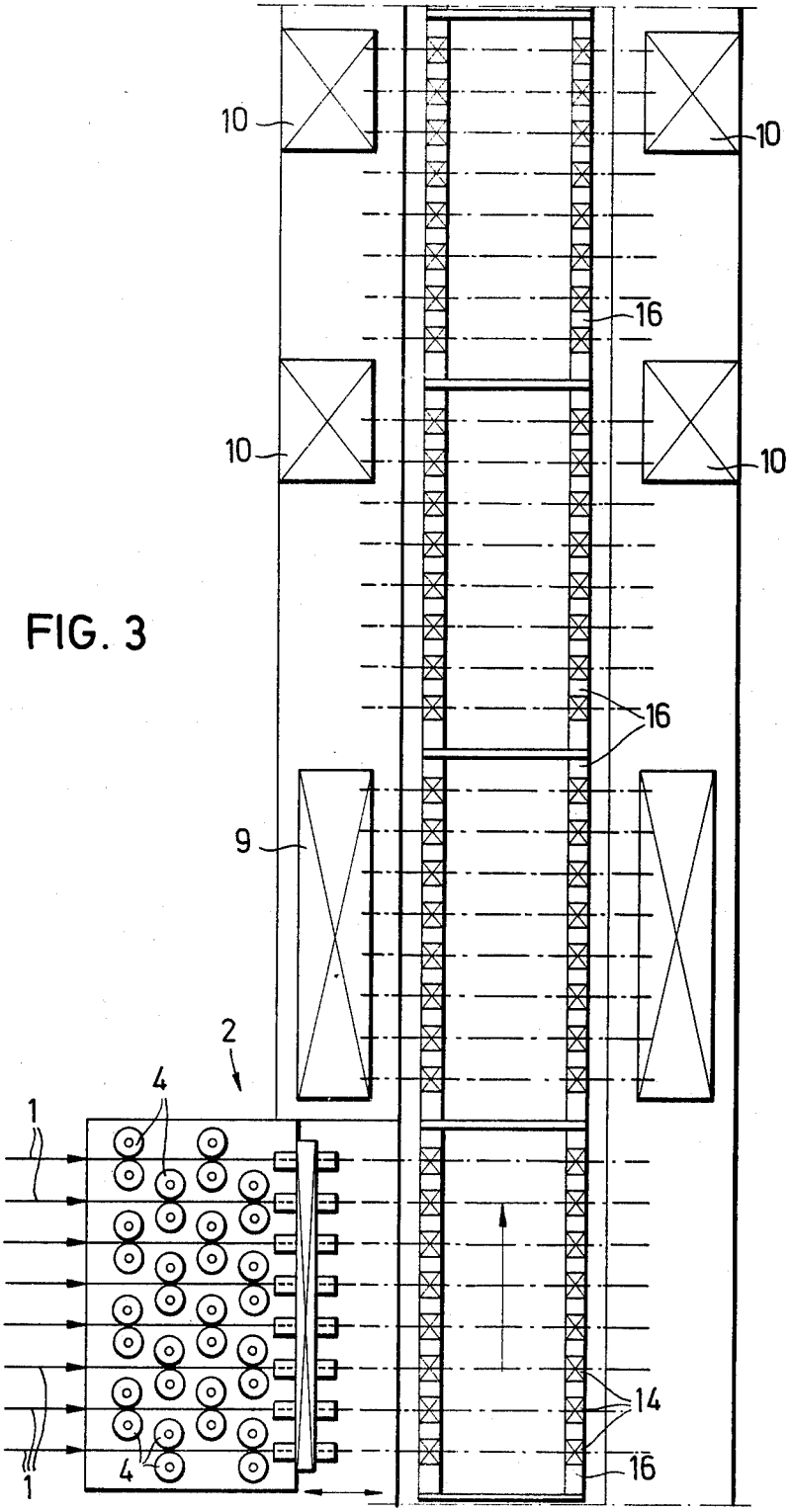
FIG. 3 is a schematic representation of a top view of the installations similar to FIG. 2, including the cutting-to-length installation of FIG. 1 and not showing the armement installation.

As shown in FIGS. 1 and 3, the transportation installation 8 includes a cable cart 16 having a bottom, in which the cable 1 is delivered in the form of the loops 13. The transportation installation 8 includes several carts 16, where each cart 16 is provided with a pair of spaced apart rods or grippers 14, the number of pairs of grippers corresponds to the number of cables.

The carts 16 of the transportation installation 8 are fed or arranged in the form of rosary or prayer-beads so that the installation in accordance with the present invention can be executed in a particularly compact form. The transportation installation is disposed horizontally at right angles to the axis direction of the cable ends, as best shown in FIG. 3.

In accordance with a special embodiment of the present invention, the rollers 4 as shown in FIG. 3 are arranged preferably in a plane, in which each roller feed 2 includes several roller pairs. Each alternate roller feed 2 is displaced to one side and moved closer to its adjacent roller feed 2 to provide a compact arrangement, where the distance between two adjacent cables 1 is less than the diameters of two rollers 4 as clearly shown in FIG. 3.

The roller feeds 2 are programmable independent from each other so that the roller feeds permit one or more cables to be pulled back before the feed sets in, so that the gripper rod 3 does not grip the specific cable. Thus, the number of cables can be reduced, or only one end of the specific cable is bared and provided with a connector, as set forth above. Furthermore, the independent roller feeds 2 can be programmed for different feed speeds to provide different lengths for the cables which are fed simultaneously.

Figure 2:
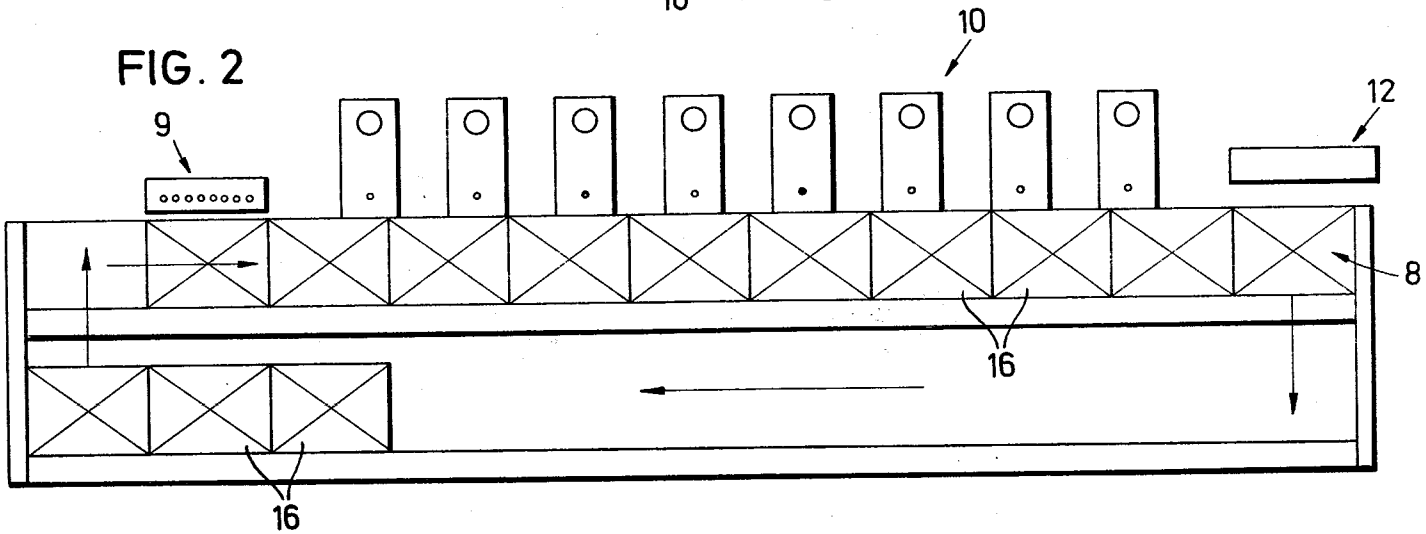
FIG. 2 is a schematic representation of a top view of additional subsequent installations in accordance with the present invention.

As indicated in FIGS. 2 and 3, the transportation installation 8 carries the cables from the cutting-to-length installation 5 to the baring-and-cutting installation 9, where the desired ends of the cables 1 are simultaneously bared and thereafter simultaneously cut. The transportation installation 8 then passes in front of several arresting machines 10, where the cables ends are gradually provided with connectors. Furthermore, if necessary, the cables ends are further transported to be sorted and armed with a casing in the armement installation 12.

Figure 6A:
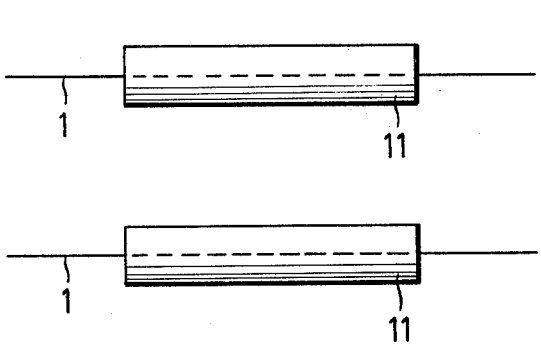
FIGS. 6*a* and 6*b* are schematic representations of the cable guides for a double binding.
Figure 6B:
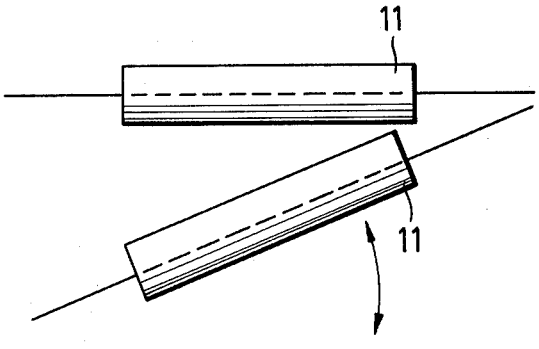

The embodiment of the present invention shown in FIG. 3, permits the positioning of the guides 11, shown larger in FIG. 6*a*, in such a manner that before the gripping of the gripper rods 3, and specifically the rear grippers 14 (and grippers 21 set forth below), a neighboring guide 11 is swung in either direction towards another adjacent guide 11, as shown in FIG. 6*b*, so that the specific ends of two or more adjacent cables 1 can run together during the roller feed. This permits this formation of the double bindings.

Figure 4:
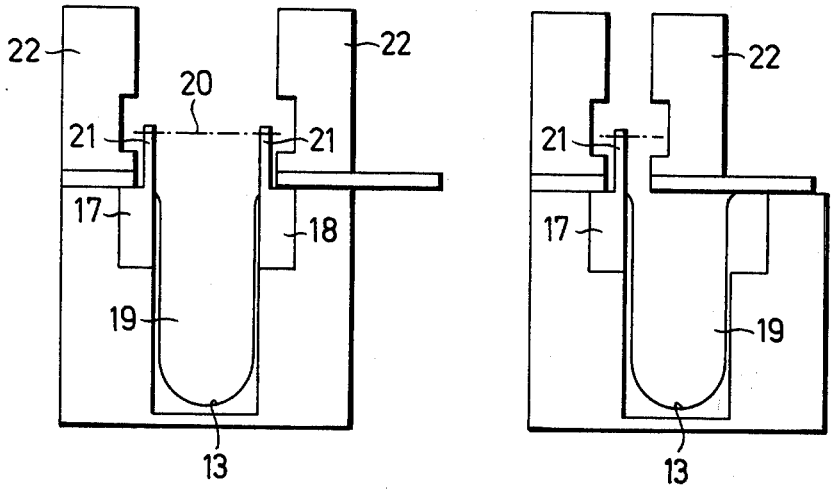
FIG. 4 shows a variant of the transportation installation shown in FIG. 1.

FIG. 4 shows a variant of the transportation installation of the present invention including two cable carts 17 and 18 installed next to each other, which is accomplished by the removal of the connecting bottom. The loops 13 of the cables 20 hang in the intermediate space 19 or are maintained at a specific length between the grippers 21 of the carts 17, 18. With this variant, it is possible to handle very short cables when one side 22 of the transportation installation is moved inwardly as is shown in the right representation of FIG. 4.

Figure 5:
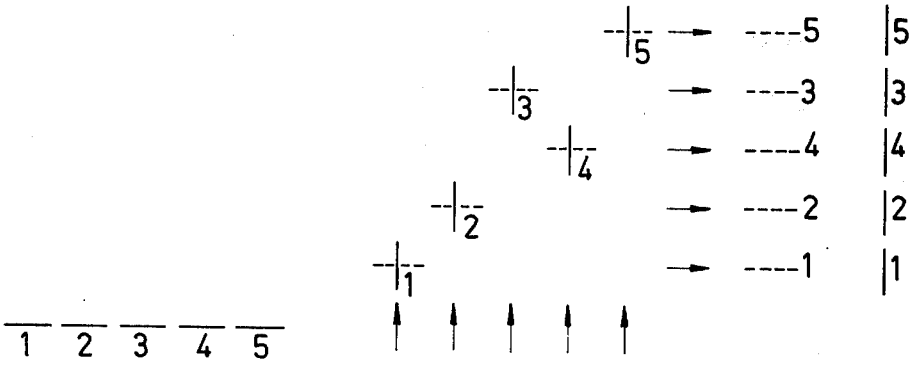
FIG. 5 is a schematic representation of the sorting, according to the present invention.

FIG. 5 represents a possible sorting scheme for the cable ends which have been provided with connectors. The cable ends are carried on different casing chamber screens, shown in positions 1 to 5, which are equal or smaller than the original cable distances. The cable ends, fed from the left side of FIG. 5, are lifted independently to different levels and turned 90° sideways in the casing chamber screen, as shown on the right side of FIG. 5.

The concept of the new procedure as well as the new installation of the present invention permits, in particular, the following manufacturings:

1. The manufacturing of partial laced wiring harnesses of equal length, including a one-sided or double-sided armement with preferably single series casings with chambers of identical or different cross-sections, and identical or different conductor colors and casings.
2. The manufacturing of partial laced wiring harnesses of equal lengths, including double-sided armement with preferably single series casings with chambers of identical or different cross-sections, and identical or different conductor colors and casings.
3. The manufacturing of partial laced wiring harnesses of unequal length, including double-sided armement with preferably single series of casings with chambers of identical or different cross-sections, and identical or different conductor colors and casings.
4. The manufacturing of partial laced wiring harnesses of unequal length including partial double-sided armement with preferably single series casings with chambers of identical or different cross-sections, and identical or different conductor colors and casings.
5. The manufacturing of partial laced wiring harnesses of unequal length including single-sided armement and preferably single series casings with chambers of identical or different cross-sections, and identical or different connector colors and connectors on the armed side.
6. The manufacturing of partial laced wiring harnesses of equal lengths including double arrests on both sides and double-sided armement with preferably single series casings with chambers of identical or different cross-sections, and identical or different conductor colors and casings.
7. The manufacturing of partial laced wiring harnesses of unequal length including double arrests on both sides and double-sided armement with preferably single series casings with chambers of identical or different cross-sections, and identical or different conductor colors and casings.
8. The manufacturing of partial laced wiring harnesses of unequal lengths including double arrests on both sides and partially double-sided armement with preferably single series casings with chambers of identical or different cross-sections, and identical or different conductor colors and casings.
9. The manufacturing of partial laced wiring harnesses of unequal lengths including double arrests and one-sided armement with preferably single series casings with chambers of identical or different cross-sections, and identical or different conductor colors and connectors on the unarmed side.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Procedure for manufacturing a partial laced wiring harness comprising:

simultaneously feeding cables from a feeder parallel to each other in a horizontal plane;

gripping a front end of at least most of said cables;

stretching said cables;

feeding said cables forward in an axial direction for a predetermined amount to form loops of predetermined length in a transportation installation;

gripping at least one end portion of each said predetermined length of cable with gripping means on said transportation installation;

cutting said cables to said predetermined length;

transporting the cut cables to at least one other area by said transportation installation, said cut cables being transported in a horizontal direction at right angles to the axial direction of said cables, with said gripping means still gripping said cable; and baring and providing said cut cables with casings and connectors at said at least one other area.

2. Procedure according to claim 1, wherein said gripping of said front end of said cables includes simultaneously gripping all said cables, said gripping means on said transportation installation gripping opposite end portions of each said predetermined length of cable, and releasing said front end of each of said cables before said cutting of said cables.

3. Procedure according to claim 1, wherein said step of said feeding said cables forward is at a predetermined speed for each of said cables to obtain different predetermined lengths of cables.

4. Procedure according to claim 1, wherein said cut cables are simultaneously bared, and simultaneously provided with casings and connectors.

5. Procedure according to claim 1, wherein said at least one end portion of each cable is cut after said baring with all said cables being cut simultaneously after said baring.

6. Procedure according to claim 1, wherein before said gripping of said front end of said cables, at least one cable is pulled back.

7. Procedure according to claim 1, wherein before said gripping of said front end of said cables, at least two adjacent cables are fed together in contact with each other.

8. Procedure according to claim 1, wherein after providing said cables with connectors, ends of said cables are sorted.

9. Procedure according to claim 8, including turning said cable ends when being sorted, said cable ends being turned from said axial direction at right angles to said transporting direction into said transporting direction, at least some of said cable ends being lifted when being sorted.

10. Procedure according to claim 8, wherein when said cables are sorted, distances between said cable ends are arranged according to distances of a casing screen.

11. An installation for manufacturing a partial laced wiring harness, comprising:

a cutting-to-length member for feeding and cutting cables, said cutting-to-length member being provided with feeder means including an independent roller feed for feeding each of said cables, first gripper means for gripping a forward free end of each cable, said first gripper means being mounted for movement on guiding elements, and a cutter disposed between said roller feed and said first gripper means for cutting said cables to a predetermined length, said first gripper means grip said cables while said feeder means feeds said cables into loop arrangements before being cut;

a transportation member for receiving said loop arrangements and for transporting the cut cables to baring, arresting and armement stations, said transportation member including second gripper means for gripping said cables before and after said cables are cut.

12. An installation according to claim 11, wherein each said roller feed includes rollers, all said rollers of said feeder means being disposed in one plane.

13. An installation according to claim 12, wherein each said roller feed includes several roller pairs, said rollers of one roller feed being displaced to one side and positioned close to said rollers on an adjacent roller feed to provide a compact arrangement.

14. An installation according to claim 11, wherein said first gripper means are movable in a forward and backward direction and in either direction perpendicular thereto.

15. An installation according to claim 11, wherein said second gripper means includes a pair of spaced apart gripper elements mounted on opposite side walls of said transportation member.

16. An installation according to claim 11, wherein said transportation member includes two associated spaced apart cable carts each provided with one of said second gripper means.

17. An installation according to claim 11, wherein said transportation member includes a series of cable carts connected together in a rosary prayer-bead arrangement.

* * * * *